US007219817B2

(12) United States Patent
Panzarella

(10) Patent No.: US 7,219,817 B2
(45) Date of Patent: May 22, 2007

(54) FLUID SLUG LAUNCHER

(76) Inventor: James Samuel Panzarella, 1001 E. Bayaud Ave., #1201, Denver, CO (US) 80209

( * ) Notice: Subject to any disclaimer, the term of this patent is extended or adjusted under 35 U.S.C. 154(b) by 0 days.

(21) Appl. No.: 10/254,987

(22) Filed: Sep. 25, 2002

(65) Prior Publication Data

US 2003/0071077 A1 Apr. 17, 2003

Related U.S. Application Data

(60) Provisional application No. 60/326,355, filed on Oct. 1, 2001.

(51) Int. Cl.
*B67D 5/42* (2006.01)

(52) U.S. Cl. ..... 222/386; 222/79; 222/340; 222/384; 446/473; 446/475

(58) Field of Classification Search ..... 222/386, 222/326, 327, 79, 78, 383.1, 340, 384, 380; 446/473, 475, 405; 124/16, 65–66, 70–73
See application file for complete search history.

(56) References Cited

U.S. PATENT DOCUMENTS

| | | | | |
|---|---|---|---|---|
| 3,255,938 | A * | 6/1966 | Dimmich et al. | 222/505 |
| 3,877,611 | A * | 4/1975 | Morrison et al. | 222/78 |
| 4,083,477 | A * | 4/1978 | Zetterberg | 222/386 |
| 5,241,944 | A * | 9/1993 | Rappaport | 124/67 |
| 5,322,191 | A * | 6/1994 | Johnson et al. | 222/79 |
| 5,332,120 | A * | 7/1994 | D'Andrade et al. | 222/78 |
| 5,662,244 | A * | 9/1997 | Liu et al. | 222/79 |

* cited by examiner

*Primary Examiner*—Frederick C. Nicolas
(74) *Attorney, Agent, or Firm*—Frost Brown Todd LLC

(57) ABSTRACT

Apparatus for projecting a slug of liquid through the air. The invention provides means to accelerate liquid molecules to substantially equal velocity, and then to release them with minimal turbulence.

35 Claims, 8 Drawing Sheets

FLUID SLUG LAUNCHER

This application claims the benefit of U.S. Provisional Application No. 60/326,355, filed on Oct. 1, 2001.

BACKGROUND OF THE INVENTION

1. Field of the Invention

This invention relates generally but not exclusively to toy projectile launchers, and in particular to a mechanism which will hurl substantially intact "slugs" of fluid through the air.

2. Description of the Prior Art

From the dawn of time, humans have sought to create devices to launch solid projectiles. These devices were originally used for survival in hunting, attack, and defense. They may by now be a part of the human psyche. As such, projectile launchers are an eternally popular child's toy.

In one prior art variant of such toys, a gun-like launcher supports one or more projectiles, which are launched either through a spring-loaded launching mechanism or an air pressure driven launching device. The projectiles have enjoyed equally varied shapes and have included ping-pong balls, foam resilience balls, lightweight missiles and foam bodied arrows or missiles. Exemplary of such prior art solid projectile launchers are those described in U.S. Pat. No. 4,892,081 (1990) issued to Moormann and U.S. Pat. No. 4,694,815 (1987) issued to Moormann.

Many prior art water launchers also exist. The toy industry is highly competitive, and hundreds of different water launchers have been developed over the years in an attempt to profit from the toy's inherent popularity. However, in the prior art, the water launched has never appeared to be a solid, compact projectile. Instead, the shape of the water launched has fallen into one of three basic categories. The first category is a continuous stream of water interrupted periodically, such as that produced by the basic Squirt Gun. The second category launches an elongated, broken, or irregular mass of water, similar to the pattern produced by throwing water from a cup or bucket. Lastly, there are devices which launch a plurality of droplets. No toy device has, as yet, launched a slug of water which is so substantially free of accompanying droplets that it resembles a stone flying through the air.

One example of the "continuous stream" launcher is described in U.S. Pat. No. 5,074,437 (1991) of D'Andrade, et al. In this device, air pressure is built up and stored by a pumping action, and then selectively used to pressurize stored water. When the trigger is activated, the movement of the pressurized water through the narrow nozzle produces a stream of propelled water. This stream continues while the trigger is engaged, and ceases when the trigger is disengaged or when the driving pressure of the water equals atmospheric pressure. A second example of the "continuous stream" launcher is described in U.S. Pat. No. 5,433,646 (1995) of Tarng. This device automatically interrupts the water stream at a substantially high frequency, without requiring recycling of the trigger.

An example of the "irregular mass of water" launcher is found in U.S. Pat. No. 5,339,987 (1994) of D'Andrade. This invention provides a triggered mechanism for controlled flow with a bursting release of water. The shape of this burst is elongated, irregular and consists of multiple sub-packets of water.

An example of the "multiplicity of droplets" launcher is provided by U.S. Pat. No. 5,662,244 (1997) of Liu, et al. This patent states that "The present invention provides the popular advantages of traditional water guns, but projects a water charge that may be in the form of a burst or shower of water that is more likely to land on the intended target without the need for precision in aiming."

While the foregoing described prior art devices have provided some measure of enjoyment and amusement for the user, they have disadvantages, and there remains a continuing need in the art for ever more interesting and improved launchers. Some disadvantages of the prior art for solid projectile launchers are:

(a) Solid projectiles are easily lost, thus rendering the launcher useless or limited in play value.
(b) Solid projectiles must be retrieved, thus interrupting play.
(c) Solid projectiles can cause pain or injury upon impact.
(d) Solid projectiles add additional manufacturing cost to the toy.

On the other hand, prior art water launchers cannot launch water as a discrete, compact, visibly recognizable "slug". In play, this presents the following disadvantages:

(a) A child has difficulty pretending he or she is launching a solid object such as a stone or bullet.
(b) The launched water provides no sensation of being struck by an object, and no satisfying "thud" upon impact.
(c) Because it does not resemble a discrete projectile, the water launched by prior water launchers is not well suited to traditional target games.

SUMMARY OF THE INVENTION

Accordingly, the drawbacks of the prior art are overcome by the present invention, which launches an airborne liquid projectile which looks and behaves like a solid flying object.

The theory behind the present invention is that in order for a single slug of liquid to remain intact while flying through a vacuum, each molecule of said liquid must travel in the same direction and at the same speed (that is, without turbulence). To achieve this state, the preferred embodiment of the present invention seeks to first load a predetermined quantity of liquid into a moveable container, and then to accelerate said container so that each molecule of liquid moves in the same direction and at the same speed, without turbulence. Finally, the present invention provides a means to release the slug from its container, also without inducing turbulence. It achieves this result by structuring the side walls of the container to minimize turbulence as the liquid flows by them and exits the container, and by releasing the vacuum between the rear containment wall and the liquid at the moment of deceleration of said rear containment wall. The result of such a release is an airborne, substantially intact slug of liquid, in which all molecules are moving at the same speed and in the same direction.

Objects and Advantages

Accordingly, several objects and advantages of the present invention are:

(a) Water can be used for the projectiles, and is generally available in abundant supply. This eliminates the danger of losing manufactured projectiles and thus destroying the usefulness of the toy.
(b) The pattern of play is not interrupted by the necessity of retrieving projectiles.
(c) The launcher can be sold without manufactured projectiles, reducing consumer expense.
(d) Although the projectile may be composed of water, a child can pretend he or she is launching a solid object such as a stone or bullet.

(e) The slug launched, being composed of a liquid, is not likely to cause pain or injury upon impact.

(f) Unlike prior art water launching toys, the present invention fires a projectile which simulates a solid object. This provides a sensation of being "hit", and the sound of a "thud" upon impact.

(g) The present invention can be applied to target games which were designed for use with solid projectiles.

(h) A discrete slug of water many times the volume of a raindrop can be launched through the air. Since a water slug of this size is rarely seen in nature, the effect is magical, and creates the opportunity for an exciting and saleable toy. The magical quality also provides the opportunity for compelling television commercials and packaging graphics.

(i) Both solid projectile launchers and water squirters have been hugely successful products in the marketplace. The present invention combines the advantages of both, creating a unique new product niche.

Further objects and advantages of the present invention will become apparent from a consideration of the drawings and ensuing description.

BRIEF DESCRIPTION OF THE DRAWINGS

In the detailed description of the invention presented below, reference is made to the accompanying drawings, in which:

FIG. 1-B is a cross-sectional side view of FIG. 1-A;

FIG. 1-C is a perspective view of the "moving cylinder and moving piston" version of the present invention, in the "just-fired" position;

FIG. 1-D is a cross-sectional side view of FIG. 1-C;

FIG. 2-B is a cross-sectional side view of FIG. 2-A;

FIG. 2-C is a perspective view the "moving cylinder and rear opening" version of the present invention, in the "just-fired" position;

FIG. 2-D is a cross-sectional side view of FIG. 2-C;

FIG. 12-B is a cross-sectional side view of the "fixed container and moving piston" version of the present invention, in the "release piston" position;

FIG. 12-C is a cross-sectional side view of the "fixed container and moving piston" version of the present invention, in the "stop piston" position;

Figure 1C:
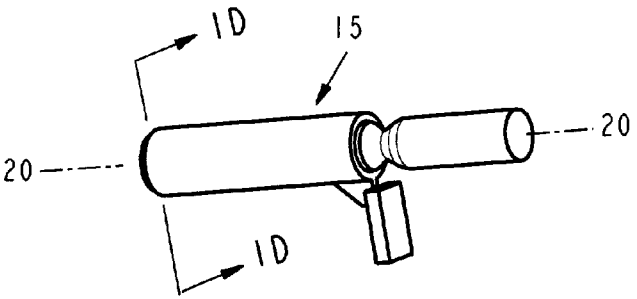
FIG. 1-A is a perspective view of a "moving cylinder and moving piston" version of the present invention, in the "ready-to-fire" position.

| Reference Numerals In Drawings | |
|---|---|
| 15 | moving container and moving piston liquid slug launcher |
| 16 | container |
| 17 | piston |
| 18 | liquid slug |
| 19 | stop |
| 20 | longitudinal axis (of container 16) |
| 21 | rear collar (of piston 17) |
| 22 | moving container and rear opening liquid slug launcher |
| 23 | axis (of container 24) |
| 24 | container |
| 25 | valve |
| 26 | liquid slug |
| 27 | stop |
| 28 | water slug launcher |
| 29 | launcher assembly |
| 30 | container |
| 31 | water slug |
| 32 | piston |
| 33 | compression spring |
| 34 | elastic drive band |
| 35 | housing |
| 36 | opening |
| 37 | housing rails |
| 38 | catch |
| 39 | arm (of piston 32) |
| 40 | safety door |
| 41 | door push spring |
| 42 | elastic door return spring |
| 43 | valve axis |
| 44 | water tank |
| 45 | draw tube |
| 46 | one-way draw valve |
| 47 | pump body |
| 48 | one-way delivery valve |
| 49 | delivery hose |
| 50 | pump lever |
| 51 | pump lever pivot pin |
| 52 | pump piston |
| 53 | pump piston pivot pin |
| 54 | pump spring |
| 55 | sliding handle |
| 56 | notches in container 30 |
| 57 | catch pivot pin |
| 58 | catch spring |
| 60 | flange |
| 61 | angled surface |
| 62 | container bottom protrusion |
| 63 | elastic stop band |
| 64 | container side protrusion |
| 65 | door axis |
| 66 | fixed container and moving piston liquid slug launcher |
| 67 | fixed container |
| 68 | axis of container |
| 69 | piston |
| 70 | liquid slug |
| 71 | rear collar |

DETAILED DESCRIPTION OF THE PRESENT INVENTION

An Explanation of the Physics of Projecting a Slug of Liquid Through the Air The present invention propels a discrete slug of liquid through the air, with few or no accompanying droplets. The effect is unique, because airborne slugs of liquid substantially larger than raindrops are rarely seen in nature. The description of this invention therefore begins with a discussion of the physics of airborne liquids.

It is known that raindrops break into smaller droplets if they accumulate too much size as they fall. Indeed, equations have been developed to calculate what the maximum size of a water droplet will be, as it falls toward earth. The variables in these equations are primarily based on the droplet's shape, its mass, the speed at which it is moving, and the density of the air through which it is passing. In common terms, as a slug of water traveling through the air increases in speed, the pressure of the air against the advancing face of the water slug will eventually cause it to flatten out and break into smaller droplets. These smaller droplets may continue to flatten and break, until the resultant droplets are small enough that their terminal velocity in freefall is not sufficient to break them.

The preferred embodiment of this invention launches a cylindrical water slug of approximately 2 cubic centimeters in volume. As the slug travels through the air, the pressure of the air against its advancing face, and the internal attractive forces within the liquid itself, cause it to originally gather into a somewhat spherical shape. However, if the liquid slug continues to move at too high a speed, the pressure of the air against its advancing face will ultimately cause it to flatten and break.

Experiments with prototypes of the invention showed that when the volume of the water slug was increased, the maximum velocity at which the slug broke decreased. Inversely, when the volume of the water slug was decreased, the maximum velocity at which the slug broke increased. In another experiment, by varying the airborne speed of the water slug, the maximum velocity of the cylindrical 2 cc. slug before breakage was found to be about 22 miles per hour, at sea level air pressure. This information was used to select a drive spring for the prototype which released the liquid slug at just below 22 miles per hour.

Our attention now turns to the problem of accelerating and releasing a single slug of liquid into the air, with little or no accompanying droplets. The problem is solved by the realization that in order for a liquid slug to stay intact when it is released, each molecule of liquid within the slug should move at the same speed and in the same direction. If this condition is met, there will be no force except air pressure to break the slug. However, if the liquid slug is released while in a state of turbulence, that is, if its molecules are moving at dissimilar velocities, the liquid may split off into different pieces which move in different directions. The first problem solved by the present invention is that of accelerating the liquid slug without inducing turbulence. The second problem overcome is that of releasing it without inducing turbulence.

The solution which the present invention provides to the first problem is to accelerate the slug while it is retained within the fixed walls of a container. Since the container walls are rigid, the seams are sealed, and there is no compressible liquid such as air within or behind the slug, there is no place for the liquid molecules to move, and thus no turbulent flow is induced. Even if the front of the container is left open, the liquid molecules will not tend to flow in that direction, since the force of acceleration presses them to the rear. Therefore, when the liquid slug has been accelerated and is ready to be released from the container, all liquid molecules are moving at the same speed and in the same direction.

The solution to the second part of the problem, how to release the liquid slug without inducing turbulence, is provided in the present invention by two measures. The first measure is to release the vacuum at the rear of the slug after acceleration ceases so that the liquid can freely leave the container. The second measure is to construct the side walls of the container so that they are substantially parallel to the direction of acceleration of the container. This allows the molecules of the liquid slug which are in contact with the container walls to leave the container without substantially changing their speed or direction.

Figure 12A:
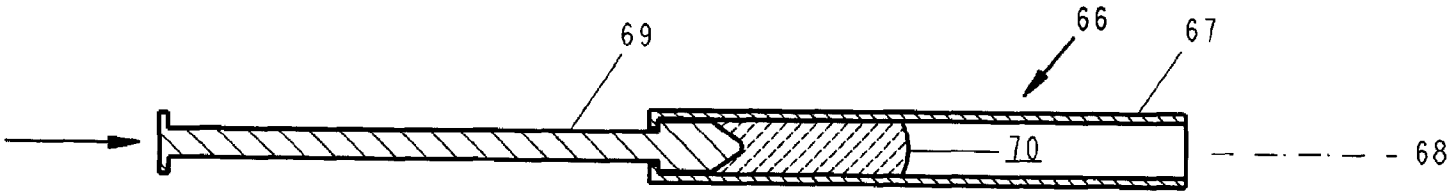
FIG. 12-A is a cross-sectional side view of a "fixed container and moving piston" version of the present invention, in the "ready to accelerate piston" position.
Figure 12B:
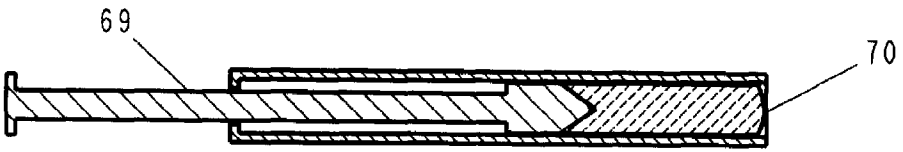
Figure 12C:
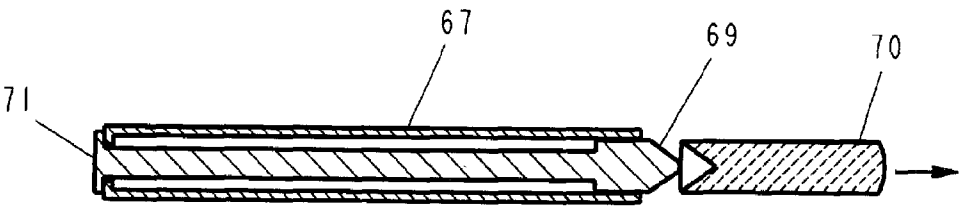

FIGS. 1A, 1B, 1C, and 1D illustrate one embodiment of the present invention, FIGS. 2A, 2B, 2C, and 2D illustrate a second embodiment, and FIGS. 12A, 12B, and 12C illustrate yet a third. All three utilize the previously stated principles to launch liquid slugs.

First Apparatus to Accelerate and Release a Liquid Slug

Figure 1D:
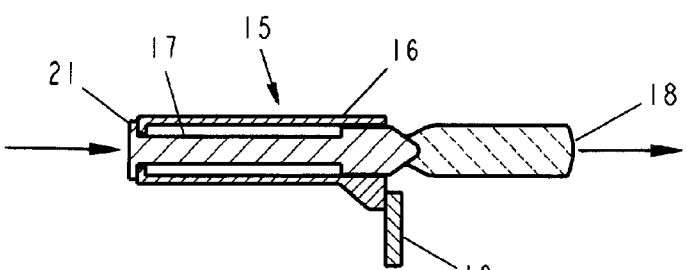
Figure 1A:
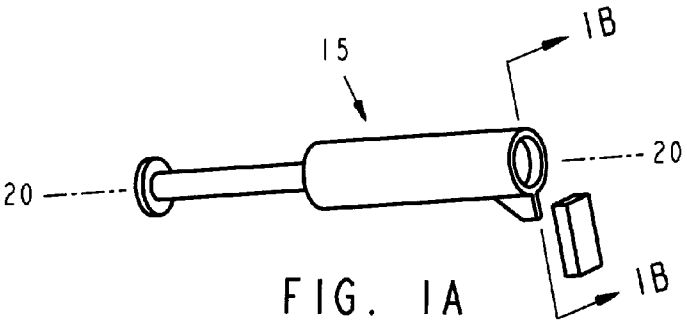
Figure 1B:
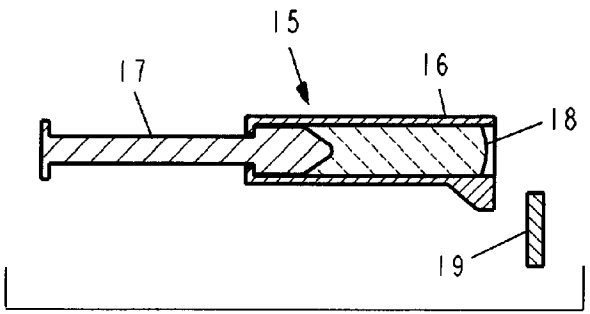
Figure 2C:
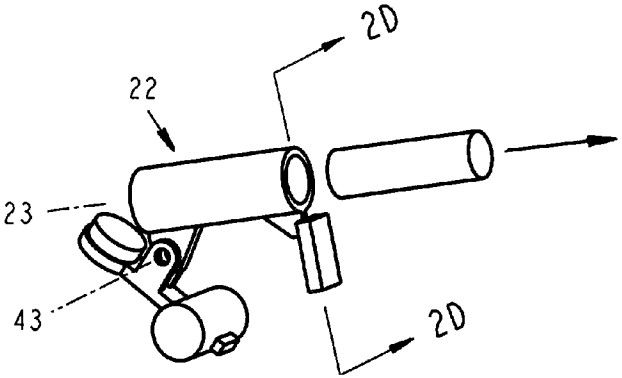
FIG. 2-A is a perspective view of a "moving cylinder and rear opening" version of the present invention, in the "ready-to-fire" position.
Figure 2D:
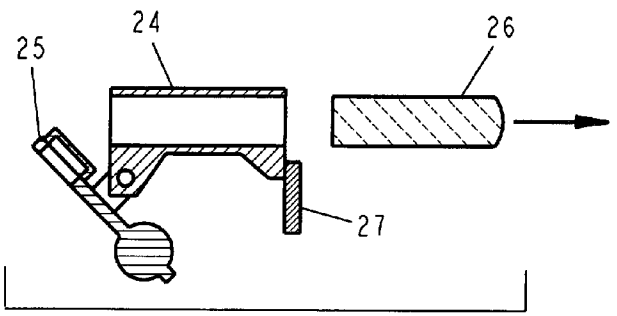
Figure 2A:
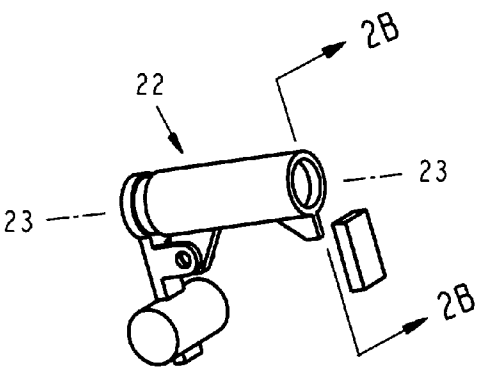
Figure 2B:
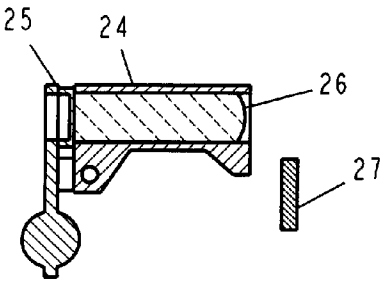

Referring now to FIG. 1A and FIG. 1B, there is shown respectively a perspective and side-cut view of a "moving container and moving piston liquid slug launcher" 15 in the "ready-to-fire" position, which is referred to as Phase One. In this embodiment, launcher 15 includes a container 16 for liquid, with the side walls of container 16 parallel to a longitudinal axis 20 of container 16, an opening at the right end of axis 20, and a second opening at the left end of axis 20. The opening at the left end is sealed against liquid leakage by a seated piston 17. A liquid slug 18 is shown inside container 16. In this orientation, a vacuum at the rear and sides of liquid slug 18 tends to prevent it from exiting the right opening of container 16.

In what is referred to as Phase Two of the present invention's operation, a force is applied to container 16, causing it to accelerate along axis 20 and in the direction indicated by the arrow of FIG. 1D. Since piston 17 and liquid slug 18 are retained by container 16, they will accelerate at the same rate as container 16. Therefore, in this phase, all three components move at the same velocity.

In Phase Three, container 16 strikes a stop 19. This causes container 16 to decelerate, while piston 17 and liquid slug 18 continue to travel at their previous velocities.

FIG. 1C and FIG. 1D show Phase Four, the "just fired" position, wherein liquid slug 18 is released into flight. At this point in time, container 16 has decelerated and piston 17 and liquid slug 18 have moved forward together, until the forward motion of piston 17 is slowed due to a rear collar 21 proximally attached via a stem to piston 17 striking the end of container 16. Since liquid slug 18 and the tip of piston 17 are outside container 16 when this occurs, the only vacuum which retains liquid slug 18 is at the tip of piston 17. In this position, liquid slug 18 can break away from the slower moving piston 17, with relatively little resistance. If desired, the tip or leading edge of piston 17 may be shaped to minimize friction and disturbance to liquid slug 18 as it breaks away.

In Phase Five, piston 17 is drawn back to the original position described in Phase One, and a fresh slug of liquid is loaded into container 16. At this time the launching cycle may recommence.

Second Apparatus to Accelerate and Release a Liquid Slug

FIG. 2-A and FIG. 2-B respectively show a perspective and side-cut view of a second embodiment of the present invention. In this embodiment, the left end of a container 24 opens at the moment of deceleration. "Moving container and rear opening liquid slug launcher" 22 is shown in the "ready-to-fire" position, now called Phase A. Launcher 22 includes container 24 for liquid, with the side walls of container 24 parallel to a longitudinal axis 23 of container 24, an opening at the right end of axis 23, and a second opening at the left end of axis 23. The opening at the left end is sealed against leakage by a valve 25, which is rotatable about a valve axis 43. The inertial properties of valve 25 are such that the product of the distance of the center of mass of valve 25 below valve axis 43 multiplied by the mass of valve 25 below valve axis 43 will significantly exceed the product of the distance of the center of mass of valve 25 above valve axis 43 multiplied by the mass of valve 25 above valve axis 43. A liquid slug 26 is shown inside the container. In this position, a vacuum at the rear and sides of liquid slug 26 tends to prevent it from exiting the right opening of container 24.

In operation, during Phase B of this embodiment, a force is applied to container 24, causing container 24, valve 25, and liquid slug 26 to accelerate along axis 23 and to the right. Under acceleration, the greater moment of the mass of valve 25 below valve axis 43 than above it creates a clockwise moment about valve axis 43, pressing valve 25 more tightly against the left opening of container 24 and thus sealing against leakage. In this phase, container 24, valve 25, and liquid slug 26 all move at the same velocity at any point in time.

In Phase C, container 24 decelerates after striking a stop 27. At the same time, the greater moment of mass below the axis of valve 25 will cause it to open by rotating counter-clockwise, while the inertia of liquid slug 26 will cause it to continue traveling forward. Since the only vacuum retaining liquid slug 26 is at the surface of valve 25, liquid slug 26 will break away from the retreating valve 25 with relatively little resistance, deformation, or induction of turbulence. If desired, the surface of valve 25 which is in contact with liquid slug 26 may be shaped to minimize friction and to allow liquid slug 26 to break away smoothly and with as little disturbance as possible.

FIG. 2-C and FIG. 2-D show Phase D, the "just-fired" position. Container 24 has decelerated, valve 25 has opened, and liquid slug 26 has been released into flight, in the direction of the arrow.

In Phase E, means is provided to rotate valve 25 back to the original position described in Phase A, and a fresh slug of liquid is loaded into container 24. The launching cycle can now recommence.

Third Apparatus to Accelerate and Release a Liquid Slug

Referring now to FIG. 12A, there is shown respectively a side-cut view of a "fixed container and moving piston liquid slug launcher" 66 in the "accelerate piston" position, referred to as Phase One. In this embodiment, launcher 66 includes a fixed container 67 for liquid, with the side walls of container 67 parallel to a longitudinal axis 68 of container 67, an opening at the right end of axis 68, and a second opening at the left end of axis 68. The opening at the left end is sealed against liquid leakage by a seated piston 69. A liquid slug 70 is shown inside container 67. In this orientation, a vacuum at the left and sides of liquid slug 70 tends to prevent it from exiting the right opening of container 67.

In what is referred to as Phase Two of operation, container 67 is held stationary while a force is applied to piston 69, causing piston 69 to accelerate along axis 68 and in the direction indicated by the arrow. Since liquid slug 70 is retained by container 67, it is forced to accelerate at the same rate as piston 69. Therefore, in this phase, both components always move at the same velocities.

The "release piston" position is illustrated by FIG. 12B. In this third phase, the accelerating force is discontinued, allowing piston 69 and liquid slug 70 to continue moving unimpeded at constant velocity.

Finally, FIG. 12C shows Phase Four, the "stop piston" position, wherein liquid slug 70 has been released into flight in the direction indicated by the arrow. At this point in time, the forward motion of piston 69 has been halted due to a rear collar 71 of piston 69 striking the left end of fixed container 67. This causes liquid slug 70 to break away from piston 69 and continued on, unimpeded.

In Phase Five, piston 69 is drawn back to the original position described in Phase One, and a fresh slug of liquid is loaded into container 67. At this time the launching cycle may recommence.

The Preferred Embodiment Launcher Assembly

Figure 3:
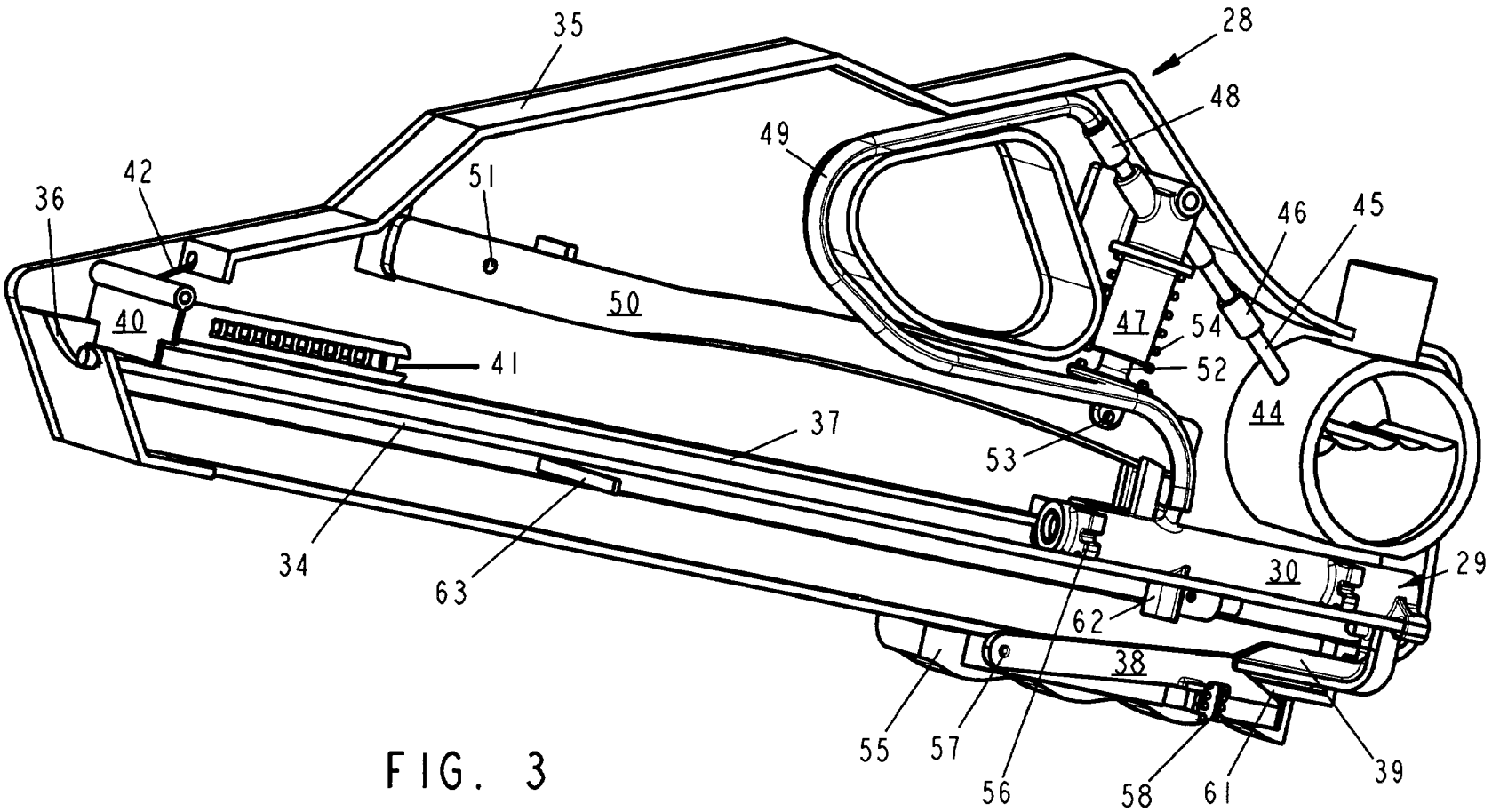
FIG. 3 shows a perspective left side view of the preferred embodiment of the present invention, in the "ready-to-fire" position, with the left side panel removed.

FIG. 3 shows a perspective side view of the preferred embodiment of the present invention, a water slug launcher 28, in the "ready-to-fire" position, and with the left side panel removed.

Figure 5:
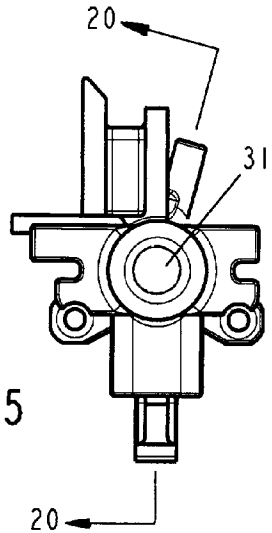
FIGS. 4, 5, and 6 respectively show perspective, front, and cross-sectional left side views of the launcher assembly of the preferred embodiment, in the "ready-to-fire" position.
Figure 4:
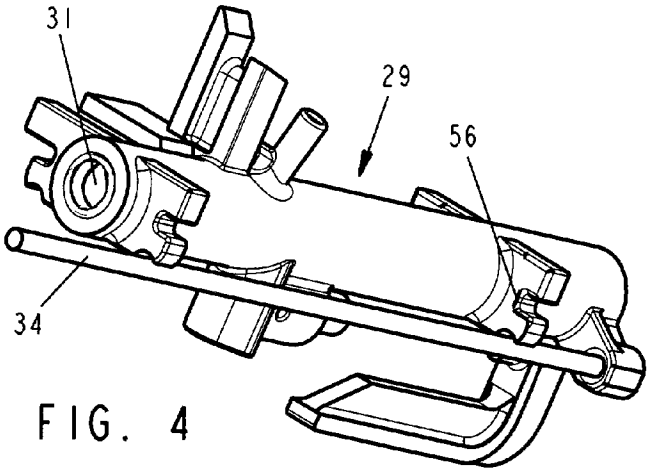
Figure 6:
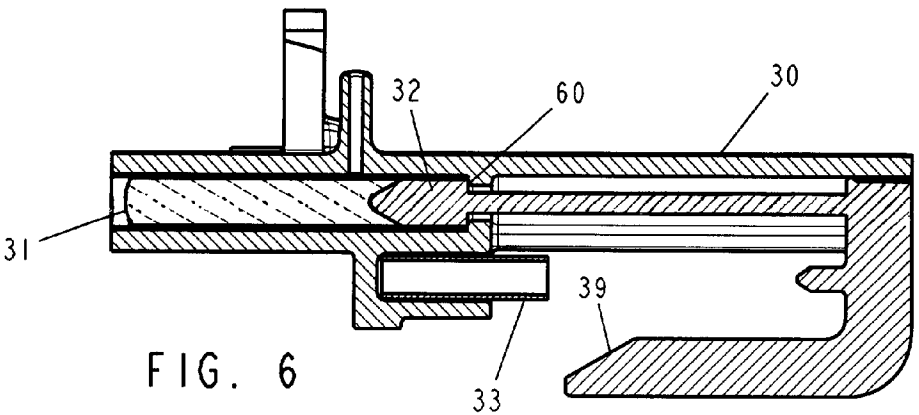

FIGS. 4, 5, and 6 respectively show perspective, front, and side-section views of a launcher assembly 29, in the "ready-to-fire" position. Assembly 29 comprises a container 30, a water slug 31, a piston 32, a compression spring 33, and an elastic drive band 34. These are the principle moving parts which operate to launch water slug 31.

Figure 9:
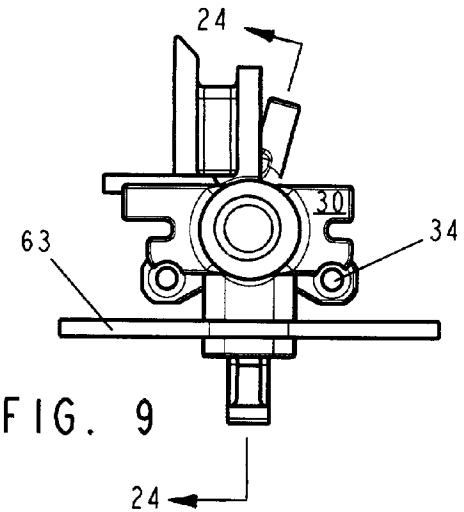
FIGS. 8, 9, and 10 respectively show perspective, front, and cross-sectional left side views of the launcher assembly of the preferred embodiment, in the "just-fired" position.
Figure 8:
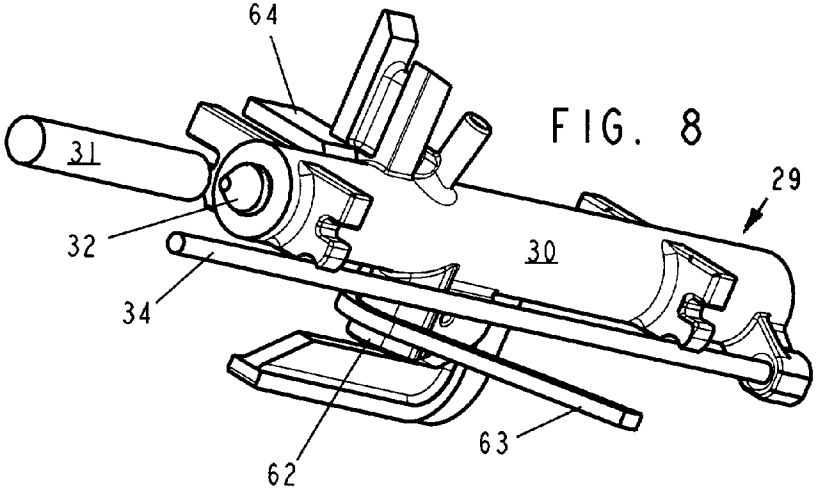
Figure 10:
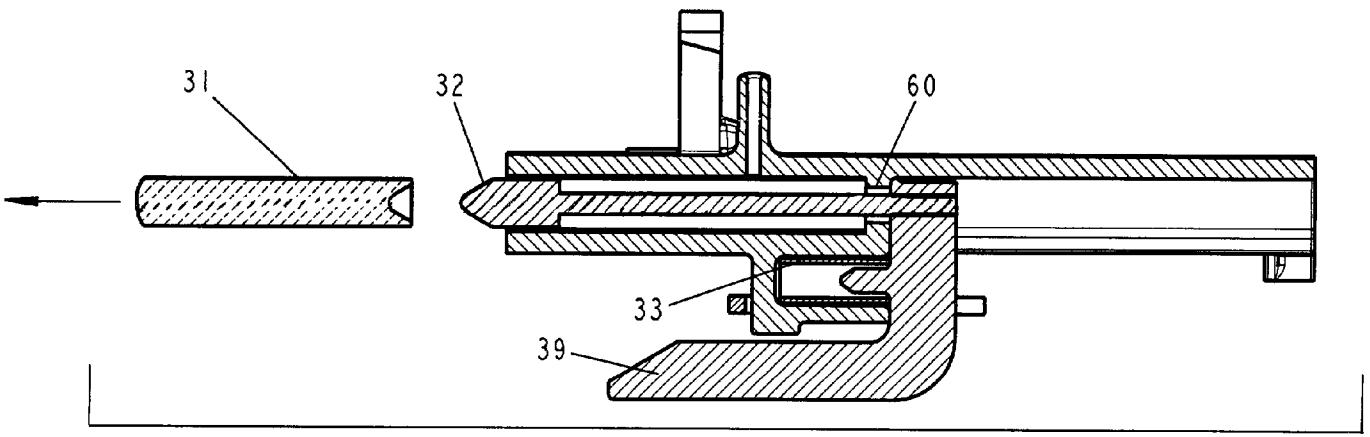

FIGS. 8, 9, and 10 respectively show perspective, front, and side-section views of launcher assembly 29, in the "just-fired" position. Piston 32 has been halted in its forward position, with its tip protruding from container 30. Water slug 31 has broken free from the tip of piston 32, and is airborne in the direction of the arrow of FIG. 10.

Referring now to FIG. 3, at the front of a housing 35 there is an opening 36, through which water slug 31 will emerge after launching. Assembly 29 is retained within housing 35 by notches 56 on each side of container 30, which are engaged with and slide freely on housing rails 37, thereby allowing assembly 29 to reciprocate within housing 35 from right to left and back again.

Assembly 29 is shown in the "ready-to-fire" position, with drive band 34 stretched taut between container 30 and the front of housing 35. Although drive band 34 is exerting a force to pull assembly 29 forward, assembly 29 is restrained from moving by a catch 38, which is locked against an arm 39 of piston 32.

The Preferred Embodiment Safety Door Assembly

Figure 7:
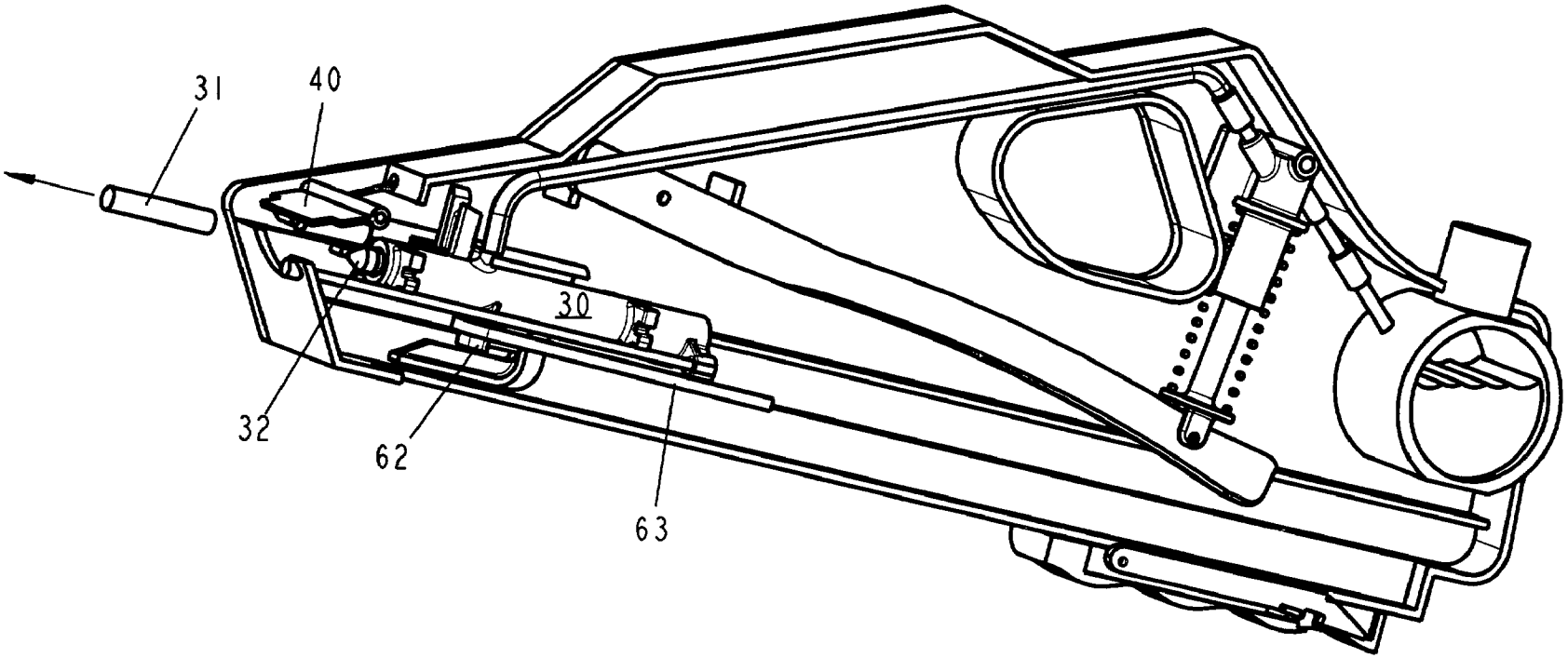
FIG. 7 shows a perspective left side view of the preferred embodiment, in the "just-fired" position, with the left side panel removed.
Figure 11:
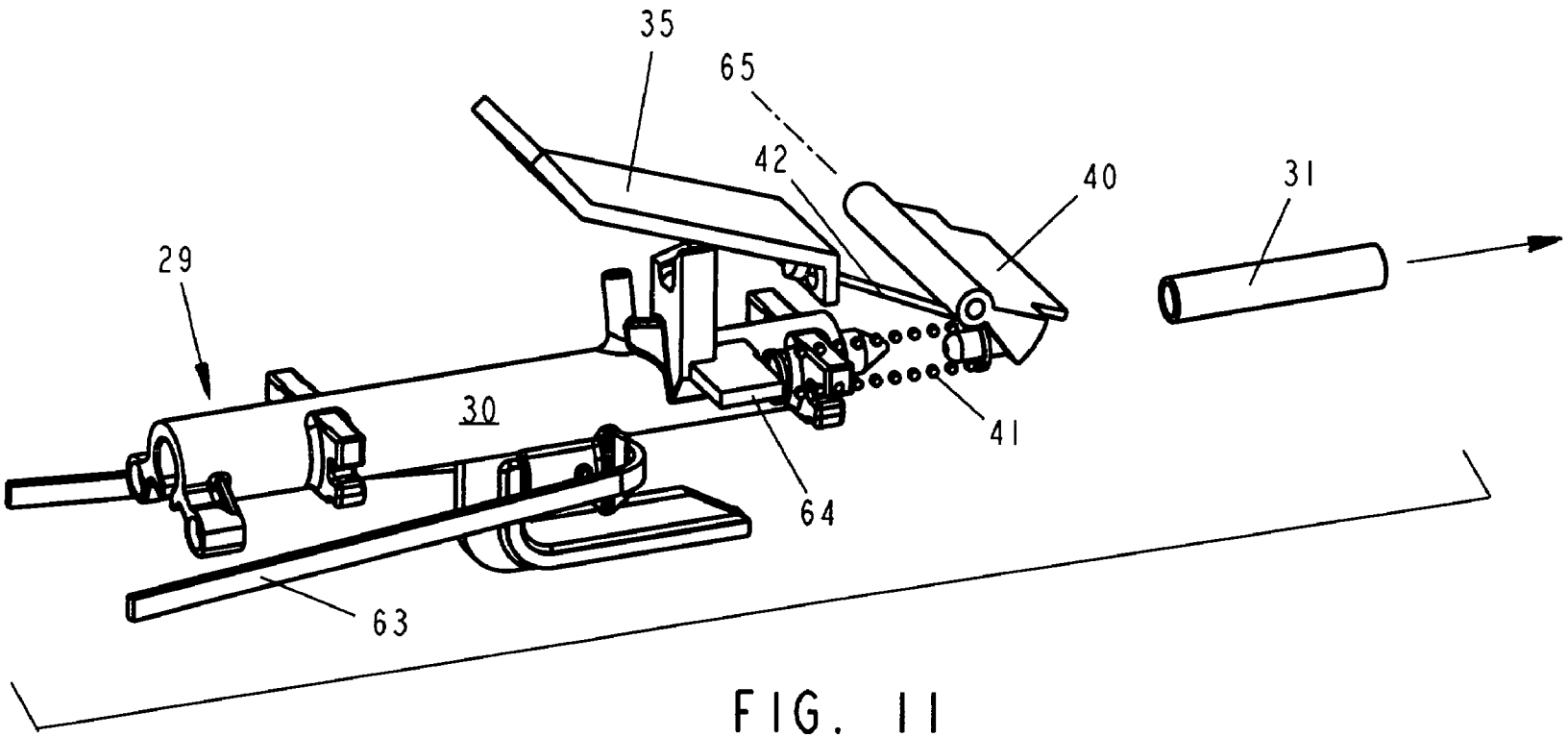
FIG. 11 is a break-away right side perspective view, showing the components of the safety door assembly in the "just-fired" position.

FIGS. 3, 7, and 11 show the components of the safety door assembly. A safety door 40 prevents a person from inserting an improvised projectile into container 30, or in the path of assembly 29, thus assuring that only liquids can be launched.

Now referring to FIG. 11, which is a break-away perspective view of the components of the safety door assembly in the "just-fired" position, the components shown are door 40, a door axis 65, a door push spring 41, an elastic door return spring 42, assembly 29, and a container side protrusion 64. During operation, when container 30 travels to the front of launcher 28, protrusion 64 strikes push spring 41. As protrusion 64 continues to move forward, door 40 is rotated open about door axis 65 by the force of protrusion 64, transmitted by push spring 41 against the rear of door 40. While door 40 is open, water slug 31 passes through opening 36, unimpeded. As an elastic stop band 63 completely arrests the forward motion of assembly 29, and then pulls assembly 29 back toward the right end of housing 35, the pressure exerted against door 40 by push spring 41 is thereby released, and spring 42 quickly closes door 40.

One advantage provided by this arrangement of components is that the length, spring rate, and initial tension of push spring 41 and the length, spring rate, and initial tension of return spring 42 can be adjusted to cause door 40 to remain open only for the instant in which the speeding water slug 31 passes through the region of door 40. This very short period of time prevents a person from reacting quickly enough to catch door 40 in the open position, hold it open, and then insert an improvised projectile into launcher 28. A second advantage is that in its rest position, door 40 cannot be opened to insert an improvised projectile, since there is insufficient space provided between housing 35 and door 40 to insert a finger behind door 40 and thereby pull it open. Once again, this will prevent the subsequent insertion of an improvised projectile. A third advantage is that door 40 prevents a person's finger from being inserted into the path of assembly 29 and thus being struck by assembly 29. A fourth advantage is that if a finger is inserted into opening 36, or held against the front of door 40, no significant impact will be felt when launcher 29 is fired. This is because push spring 41 possesses a spring rate which is so low that it exerts only a soft force against door 40, even when protrusion 64 strikes the opposite end of push spring 41.

The Preferred Embodiment Charge-and-Release Mechanism, and Water Delivery System Also depicted in FIG. 3 is a water delivery system, which transports water from a water tank 44 into container 30. In one complete cycle of operation, the water flows sequentially from tank 44, through a draw tube 45, through a one-way draw valve 46, into the inner chamber of a pump body 47, through a one-way delivery valve 48, through a delivery hose 49, and thereafter into the internal chamber of container 30. It should be noted that when the internal chamber of container 30 is loaded with water, and container 30 is tilted downward toward its opening, the water load is restrained from running out of container 30 by the vacuum seal at the rear of the container chamber, and also by the seal provided by valve 48. Valve 48 is sealed due to its initial cracking pressure, which in the case of this preferred embodiment exceeds the pressure of a ten inch column of water. Experiments with prototypes of this embodiment showed that when these seals are intact, the water load will not run out of the container chamber if the diameter of the chamber opening is less than about 0.32 inches.

Referring again to FIG. 3, a pump lever 50 is attached, by a pump lever pivot pin 51 at its left end, to housing 35. A pump piston 52 is attached by a pump piston pivot pin 53 to lever 50. In the "water delivery" stage, lever 50 is raised as assembly 29 is drawn to the right, rotating lever 50 counterclockwise about pivot pin 51. This drives piston 52 into the inner chamber of pump body 47, forcing the water contents of said inner chamber into hose 49. As this occurs, water is prevented from moving into tube 45 by valve 46. Since the water delivery system has already been primed, a slug of water equal in volume to that displaced from the inner chamber of pump body 47 is therefore forced into container 30. In the "water draw" stage, a pump spring 54 pushes against lever 50, rotating lever 50 clockwise about pin 51. As a result, a quantity of water is drawn by vacuum from tank 44, through tube 45 and valve 46, and into pump body 47. As this occurs, valve 48 prevents water from being drawn into pump body 47 through hose 49.

The Firing Cycle of the Launcher

A sliding handle 55 is mounted below housing 35, in this embodiment utilizing notches on the sides of handle 55 which engage with rails in housing 35. The rails are not pictured. This configuration allows handle 55 to slide freely back and forth in the same directions of motion as assembly 29. The following sequence of events describes one complete launching cycle, assuming that a water slug has just been launched:

The cycle commences with assembly 29 resting at the left side or front of housing 35, and the handle resting at the rear of housing 35. The operator pushes handle 55 from the rear of housing 35 to the front. At that point, catch 38, which is pivoted within handle 55 by catch pivot pin 57 and continually biased upward by a catch spring 58, slides underneath the lower portion of arm 39 of piston 32, and then snaps back upward, engaging arm 39 at its left extremity.

Next, the operator pulls handle 55 to the right, or toward the rear of housing 35. As this occurs, elastic drive band 34, which is connected between the front of housing 35 and container 30, is drawn increasingly taut. Additionally, as handle 55 moves to the right, the following actions occur sequentially:

Container 30 remains in place, while piston 32 moves to the right, until the head of piston 32 contacts a flange 60 within container 30. This orientation of components is shown in FIG. 6. Referring again to FIG. 3, container 30 now begins to move to the right also, being pulled by the head of piston 32. As it travels to the right, container 30 slides under lever 50, raising lever 50 gradually. Lever 50 raises piston 52, which pushes water from pump body 47, through valve 48 and hose 49, and into container 30. Thereafter, an angled surface 61 of housing 35, shown at the bottom rear of housing 35, forces catch 38 downward, releasing the arm 39 of piston 32 and thus allowing elastic drive band 34 to pull assembly 29 forward.

Next, container 30, piston 32, and water slug 31 are all accelerated to the left by drive band 34. Although this acceleration causes the pressure in hose 49 to increase, water is prevented from flowing back into tank 44 by valve 48 and valve 46. Lever 50, now unsupported, is pushed downward by pump spring 54, thus drawing another load of water into pump body 47. As assembly 29 comes to the front of housing 35, a container bottom protrusion 62 strikes stop band 63, causing container 30 to decelerate, while piston 32 and water slug 31 continue on unimpeded.

Piston 32 now moves forward within container 30, until it is decelerated when arm 39 strikes spring 33, which is mounted within container 30. Referring to FIG. 11, at about the same time, container protrusion 64 on the right side of container 30 strikes the left end of push spring 41. Door 40 is pushed open by the force exerted by side protrusion 64 against push spring 41. At this point in time, the position of all components of the present embodiment are shown in FIGS. 7, 8, 9, 10, and 11. Both water slug 31 and the tip of piston 32 are outside the walls of container 30. Since spring 33 has decelerated piston 32 but not water slug 31, the inertia of water slug 31 forces it to break away from the slower moving piston 32. While this is occurring, the smooth conical tip of piston 32 aids in preventing water slug 31 from breaking apart as it is released, by allowing the rear portions of water slug 31 to slide gradually off the tip of piston 32. Spring 33 also assists in allowing water slug 31 to be released without breaking, by reducing the shock when piston 32 strikes container 30. Water slug 31 is thus released into flight.

Finally, stop band 63 completely arrests the forward motion of container 30 and piston 32, and they are pulled back toward the rear of housing 35, by the spring force of stop band 63. The pressure exerted against door 40 by door push spring 41 is thereby released, and spring 42 closes door

40. All moving components have now come to rest, and the operator can move sliding handle 55 forward again to begin another launching cycle.

Modifications and Variations

Obviously, numerous modifications and variations of the present invention are possible in the light of the above teachings. For example, although the embodiment shown in drawings 2A, 2B, 2C, and 2D utilizes an inertia-driven rotatable valve 25 to open the rear of container 24, the rear of container 24 could also be opened by a linear inertia valve, or by a flat plate which is able to move sideways and is opened by a spring and trigger mechanism at the instant of the container's deceleration.

Additionally, the elements and features disclosed can be adapted for use in any number of fluid projectile launching devices. For example, the principles of the present invention could be used to create a product line of toy weaponry, such as a waterslug pistol, waterslug machine gun, waterslug mortar, waterslug shotgun, and a waterslug bow-and-arrow. As a second example, the invention could be utilized in a water theme park, to hurl large balls of water at participants. As a third example, the invention could become part of a miniature toy action-figure playset utilizing water weaponry, such as miniature cannons, rocket launchers, hand held weapons, and attack planes. As a fourth example, the invention could be used to launch smoke rings or other gaseous shapes. Nor does the present invention need to be limited to a gun-type device. For example, its principles could be used to create a sporting goods item which pitches a ball of water to a batter, and is activated either manually or via a garden hose. Or, it could become a toy water sprinkler for summer play which intermittently flings balls of water at playing children. Finally, the invention could be used for devices entirely outside the field of toys; for example, for a decorative water fountain which launches balls of water into the air, for a lawn waterer, or for an industrial purpose utilizing slugs of liquid other than water. It is therefore understood that within the scope of the appended claims, the invention may be practiced, and the function and result achieved, otherwise than as specifically described in the embodiments herein.

What is claimed is:

1. A fluid slug launcher, comprising: a fluid container having a first end and an opposing end, with side walls substantially parallel to a straight axis, a substantially unrestricted exit opening at said first end of said container through which contained fluid can forward exit said container, and a second opening at the aft opposing end of said container; and a moveable piston positioned inside the side walls of said container constrained to travel inertially forward inside said container with the contained fluid in a direction parallel to said axis of said container in response to a rapid deceleration of said container, said container having an external cross section of like shape but smaller than the internal cross section of said side walls of said container, and shaped to form a seal restricting said contained fluid from substantial leaking from said second opening of said container during prior forward acceleration.

2. The fluid slug launcher according to claim 1 wherein a first stop structure is provided to stop the motion of said piston at or near said exit opening of said container.

3. The fluid slug launcher according to claim 2 wherein said moveable piston comprises a stem protruding from the rear of said piston, said stem extending through but being smaller than said second opening, said stem having a projection located at some distance from said piston, said projection being unable to pass through said second opening at the rear end of the axis, and said stem thus allowing said piston to travel freely within said container, but stopping the motion of said piston in the region of said exit orifice of said container.

4. The fluid slug launcher according to claim 1 further comprising a closing member attached to the exit opening of the container for preventing fluid leakage from the front of said container prior to said rapid deceleration.

5. The fluid slug launcher according to claim 4 wherein said closing member comprises a door rotatably mounted to said container in the region of said exit opening, said door being closed and sealing said exit opening against fluid leakage; said door operatively configured for rotating open when said container is accelerating or moving at constant velocity in a direction from said second opening toward said exit opening, allowing said contained fluid to escape when said container is decelerated in said direction.

6. The fluid slug launcher of claim 1, further comprising:

a fluid tank with an opening for loading fluid to the tank, the tank communicating with a channel which transports the fluid through a one-way valve and into a pump chamber, the pump chamber communicating through a one-way valve with a channel connected to the interior of the container, and the pump chamber containing a piston for selectively transferring fluid into the container.

7. A fluid slug launcher comprising:

a fluid container having a first end and an opposing end, with side walls substantially parallel to a straight axis, a substantially unrestricted exit opening at said first end of said container through which contained fluid can exit said container, and a second opening at the opposing end of said container;

a moveable piston positioned inside the side walls of said container having means to travel inside said container in a direction parallel to said axis of said container, having an external cross section of like shape but smaller than the internal cross section of said side walls of said container, having means to form a seal restricting said contained fluid from leaking from said second opening of said container, and a housing to retain said container, said housing allowing said container to selectively move in a direction parallel to said axis of said container; and a housing to retain said container, said housing allowing said container to selectively move in a direction parallel to said axis of said container.

8. The fluid slug launcher according to claim 7, further comprising: a rotatably mounted door, which when closed, prevents introduction of an object into said container, and a compression door push spring, which communicates with said door and opens said door when said spring is struck by said container, and a door return spring, which pulls said door closed after the contained fluid slug is released and after said container and said return spring retreat from the area of said door.

9. A fluid slug launcher comprising:

a fluid container having a first end and an opposing end, with side walls substantially parallel to a straight axis, a substantially unrestricted exit opening at said first end of said container through which contained fluid can exit said container, and a second opening at the opposing end of said container; and a moveable piston positioned inside the side walls of said container having means to travel inside said container in a direction parallel to said axis of said container, having an external cross section of like shape but smaller than the internal cross section of said side walls of said container, having a first means to form a seal restricting said contained fluid from leaking from said second opening of said container, and a second means to load fluid into said container, said second means comprising: a fluid tank with an opening for loading fluid to said tank, said tank communicating with a channel which transports the fluid through a one way valve and into a pump chamber, said pump chamber communicating through a one way valve with a channel connected to the interior of said container, and said pump chamber containing a piston for selectively transferring fluid into said container.

10. A fluid slug launcher according comprising: a fluid container having a first end and an opposing end, with side walls substantially parallel to a straight axis, a substantially unrestricted exit opening at said first end of said container through which contained fluid can exit said container, and a second opening at the opposing end of said container; and a moveable piston positioned inside the side walls of said container having means to travel inside said container in a direction parallel to said axis of said container, having an external cross section of like shape but smaller than the internal cross section of said side walls of said container, having means to form a seal restricting said contained fluid from leaking from said second opening of said container, and a means to accelerate or decelerate said container, said means selected from the group consisting of elastomeric springs, metal springs, an electrically induced force, and fluid pressure.

11. The fluid slug launcher according to claim 10 further comprising means to sequentially initiate said acceleration to said container, then decelerate said container to zero velocity, and thereafter begin the cycle over again.

12. The fluid slug launcher according to claim 11, wherein said means to initiate comprises: an elongated toothed belt rotatably mounted on said housing, capable of engaging said piston and drawing said container into a position to be accelerated, and a pickup arm rotatably mounted on said piston, having means to engage a tooth on said toothed belt and means to release said piston and said container when said pickup arm rolls off the end of said toothed belt, and means to rotate said toothed belt.

13. A fluid slug launcher, comprising:

a translating fluid container having a first end and an opposing end, with side walls substantially parallel to a straight axis, a substantially unrestricted exit opening at the first end of the container through which contained fluid can exit the container, and a second opening at the opposing end of the container;

a moveable piston portion positioned in and sized to slidingly fit inside the side walls of the container;

a housing operatively configured to guide the translating fluid container to selectively move in a direction parallel to the axis of the container; and an acceleration member attached between the housing and the translating fluid container to accelerate the translating fluid container and the moveable piston;

wherein the housing is operatively configured to arrest translation of the translating fluid container allowing inertia of the contained fluid to expel the contained fluid from the first opening of the container as a fluid slug that exits the housing, inertia of the moveable piston carrying moveable position to the first opening to avoid a lower pressure aft of the fluid slug within the container.

14. The fluid slug launcher of claim 13, wherein said moveable piston further comprises a proximal stop structure sized to contact the translating fluid container stopping the motion of said piston at or near said exit opening of said container.

15. The fluid slug launcher of claim 13, wherein the housing further comprises an aperture through which the fluid slug exits the housing, a door biased to close the aperture, and an opening mechanism responsive to arrestment of the translating fluid container to open the door.

16. The fluid slug launcher of claim 13, further comprising:

a fluid tank with an opening for loading fluid to the tank, the tank communicating with a channel which transports the fluid through a one-way valve and into a pump chamber, the pump chamber communicating through a one-way valve with a channel connected to the interior of the container, and the pump chamber containing a piston for selectively transferring fluid into the container.

17. The fluid slug launcher of claim 13, wherein the substantially unrestricted exit opening at the first end of the translating fluid container comprises a diameter sized for surface cohesion of the contained fluid to prevent leakage before translation of the translating fluid container.

18. The fluid slug launcher of claim 17, wherein the diameter of the unrestricted exit opening at the first end of the translating fluid container is at or below 0.32 inches.

19. The fluid slug launcher of claim 13, wherein the acceleration member comprises a resilient band.

20. The fluid slug launcher of claim 19, further comprising a user control handle translatable on the housing and coupled to retract the moveable piston and in turn the translating fluid container that in turn stretches the resilient band for firing.

21. The fluid slug launcher of claim 19, wherein the user control handle includes a catch aligned to engage a distally positioned proximal portion of the movable piston, the housing including a release surface positioned to disengage the catch of the handle from the movable piston with the translating fluid container proximally retracted for firing.

22. The fluid slug launcher of claim 13, wherein the movable plunger comprises a tapered distal end to transition air pressure to an aft side of fluid after exiting the first opening of the container.

23. The fluid slug launcher of claim 13, wherein the movable plunger comprises a tapered distal end to transition air pressure to an aft side of fluid after exiting the first opening of the container.

24. A fluid slug launcher, comprising:

a translating fluid container having a first end and an opposing end, with side walls substantially parallel to a straight axis, a substantially unrestricted exit opening at the first end of the container through which contained fluid can exit the container, and a second opening at the opposing end of the container;

a movable piston comprising a distal plunger portion positioned in and sized to slidingly fit inside the side walls of the container and comprising a proximal portion dynamically sealed to and extending proximally out of the second opening of the container;

a housing operatively configured to guide the translating fluid container to selectively move in a direction parallel to the axis of the container; and an acceleration member attached between the housing and the translating fluid container to accelerate the translating fluid container;

wherein the housing is operatively configured to arrest translation of the translating fluid container allowing inertia of the contained fluid and movable piston to expel the contained fluid from the first opening of the container as a fluid slug that exits the housing.

25. The fluid slug launcher of claim 24, wherein said movable piston further comprises a proximal stop structure sized to contact the translating fluid container stopping the motion of said piston at or near said exit opening of said container.

26. The fluid slug launcher of claim 24, wherein the housing further comprises an aperture through which the fluid slug exits the housing, a door biased to close the aperture, and an opening mechanism responsive to arrestment of the translating fluid container to open the door.

27. The fluid slug launcher of claim 24, further comprising:

a fluid tank with an opening for loading fluid to the tank, the tank communicating with a channel which transports the fluid through a one-way valve and into a pump chamber, the pump chamber communicating through a one-way valve with a channel connected to the interior of the container, and the pump chamber containing a piston for selectively transferring fluid into the container.

28. The fluid slug launcher of claim 24, wherein the substantially unrestricted exit opening at the first end of the translating fluid container comprises a diameter sized for surface cohesion of the contained fluid to prevent leakage before translation of the translating fluid container.

29. The fluid slug launcher of claim 28, wherein the diameter of the unrestricted exit opening at the first end of the translating fluid container is at or below 0.32 inches.

30. The fluid slug launcher of claim 24, wherein the acceleration member comprises a resilient band.

31. The fluid slug launcher of claim 30, further comprising a user control handle translatable on the housing and coupled to retract the movable piston and in turn the translating fluid container that in turn stretches the resilient band for firing.

32. The fluid slug launcher of claim 30, wherein the user control handle includes a catch aligned to engage a distally positioned proximal portion of the movable piston, the housing including a release surface positioned to disengage the catch of the handle from the movable piston with the translating fluid container proximally retracted for firing.

33. The fluid slug launcher of claim 24, wherein the movable plunger comprises a tapered distal end to transition air pressure to an aft side of fluid after exiting the first opening of the container.

34. A fluid slug launcher, comprising: a fluid container having a first end and an opposing end, with side walls substantially parallel to a straight axis, a substantially unrestricted exit opening at said first end of said container through which contained fluid can exit said container, and a second opening at the opposing end of said container; and a movable piston positioned inside the side walls of said container having means to travel inside said container in a direction parallel to said axis of said container, having an external cross section of like shape but smaller than the internal cross section of said side walls of said container, having means to form a seal restricting said contained fluid from leaking from said second opening of said container, and a fluid tank with an opening for loading fluid to the tank, the tank communicating with a channel which transports the fluid through a one-way valve and into a pump chamber, the pump chamber communicating through a one-way valve with a channel connected to the interior of the container, and the pump chamber containing a piston for selectively transferring fluid into the container.

35. A fluid slug launcher, comprising:

a fluid container having a first end and an opposing end, with side walls substantially parallel to a straight axis, a substantially unrestricted exit opening at the first end of the container through which contained fluid can exit the container, and a second opening at the opposing end of the container;

a movable piston comprising a distal plunger portion positioned in and sized to slidingly fit inside the side walls of the container; and an engaging structure formed between the fluid container and the movable piston operatively configured to maintain the movable piston at an aft position closing the second end during forward acceleration of the fluid container and operatively configured to allow inertial movement of the movable piston forward through the fluid container behind fluid inertially exiting the exit opening following a rapid deceleration of the fluid container.

* * * * *

UNITED STATES PATENT AND TRADEMARK OFFICE

CERTIFICATE OF CORRECTION

PATENT NO. : 7,219,817 B2
APPLICATION NO. : 10/254987
DATED : May 22, 2007
INVENTOR(S) : James Samuel Panzarella It is certified that error appears in the above-identified patent and that said Letters Patent is hereby corrected as shown below:

Col. 13, line 15, "A fluid slug launcher according comprising:" should be -- A fluid slug launcher comprising: --

Signed and Sealed this

Tenth Day of July, 2007

JON W. DUDAS
*Director of the United States Patent and Trademark Office*